US005288962A

United States Patent [19]

Lorence et al.

[11] Patent Number: 5,288,962

[45] Date of Patent: Feb. 22, 1994

[54] MICROWAVE COOKING ENCLOSURE FOR FOOD ITEMS

[75] Inventors: Matthew W. Lorence, Omaha, Nebr.; Charles H. Turpin, Minneapolis, Minn.

[73] Assignee: ConAgra Frozen Foods, Inc., Omaha, Nebr.

[21] Appl. No.: 976,560

[22] Filed: Nov. 16, 1992

[51] Int. Cl.[5] ..... H05B 6/80

[52] U.S. Cl. ..... 219/729; 219/10.55 F; 219/730; 426/107; 426/234; 426/243; 99/DIG. 14

[58] Field of Search ..... 219/10.55 E, 10.55 F; 426/107, 109, 234, 241, 243; 99/DIG. 14

[56] References Cited

U.S. PATENT DOCUMENTS

| | | | |
|---|---|---|---|
| 4,190,757 | 2/1980 | Turpin et al. | 219/10.55 E |
| 4,267,420 | 5/1981 | Brastad . | |
| 4,345,133 | 8/1982 | Cherney et al. . | |
| 4,499,356 | 2/1985 | Hatagawa | 219/10.55 E |
| 4,567,341 | 1/1986 | Brown . | |
| 4,594,492 | 6/1986 | Maroszek | 219/10.55 E |
| 4,626,641 | 12/1986 | Brown . | |
| 4,641,005 | 2/1987 | Seiferth . | |
| 4,841,112 | 6/1989 | Peleg | 219/10.55 E |
| 4,866,232 | 9/1989 | Stone | 219/10.55 E |
| 4,870,233 | 9/1989 | McDonald et al. | 219/10.55 E |
| 4,927,991 | 5/1990 | Wendt et al. . | |
| 4,972,059 | 11/1990 | Wendt et al. . | |
| 5,028,754 | 7/1991 | Chiba | 219/10.55 E |

*Primary Examiner*—Philip H. Leung
*Attorney, Agent, or Firm*—Pretty, Schroeder, Brueggemann & Clark

[57] ABSTRACT

An enclosure for cooking and browning pot pies and similar food items in a microwave oven is disclosed. The enclosure has a first microwave reflective shield defining a single hole therein, and a susceptor layer positioned below the first reflective shield. A pan for containing a food item and having a susceptor lining for further cooking and browning the food item is located below the first reflective shield and susceptor layer. A second microwave reflective shield defining a single hole therein can be advantageously positioned below the pot pie pan. The arrangement of the reflective shields and the susceptor layer in connection with the pan provide for the selective cooking and browning of the food item to the desired degree. Another embodiment of the present invention includes having a reflective shield defining a single hole therein positioned below the pan, along with a susceptor layer above the pan.

42 Claims, 2 Drawing Sheets

MICROWAVE COOKING ENCLOSURE FOR FOOD ITEMS

BACKGROUND OF THE INVENTION

The present invention relates to an enclosure for cooking a pot pie or similar food item in a microwave oven, and more particularly, to such an enclosure having microwave reflective shields and susceptors for cooking and browning pot pies to a desired degree on a consistent basis from oven to oven.

Specially designed packages or cartons for cooking, browning and/or crisping foods in microwave ovens have been used for quite some time. Often, these packages utilize susceptors, or microwave interactive materials which convert microwave energy to heat, to achieve proper or sufficient cooking of the foods contained in the packages. By way of example, U.S. Pat. No. 4,267,420 to Brastad and U.S. Pat. No. 4,641,005 to Seiferth describe the use of various metallized polyester films or susceptors in connection with cooking foods in microwave ovens.

The use of reflective or electrically conductive materials which selectively transmit, absorb and/or reflect microwave energy have also been used in microwave packaging to affect their cooking performance. For instance, U.S. Pat. No. 4,567,341 to Brown describes a vented, microwave pizza carton having a reflective material for shielding portions of the pizza from microwave energy to prevent overcooking.

Nonetheless, many problems, such as non-uniform cooking or browning, and overheating or underheating are still experienced in cooking various foods in microwave ovens. Although the use of reflective materials and susceptors have eliminated some of these problems, the design of a package to cook, brown, or crisp particular foods remains a challenge to the microwave package designer. Indeed, with respect to pot pies in particular, there has not been a suitable package which provides the desired and uniform level of microwave cooking and browning on a consistent basis, especially given the differences in cooking characteristics from oven to oven. As a result, most of the microwavable pot pies currently on the market require that the pot pie be removed from the package before cooking it in the microwave. Thus, the control of microwave energy to which the pot pie is exposed is mostly limited to the time and level of power at which the pot pie is cooked.

Accordingly, it will be understood that there is a need for an improved and reliable enclosure for cooking a pot pie, or similar food article, in a microwave oven, such that the pot pie is cooked and browned to a desired and uniform degree on a controlled and consistent basis from oven to oven. In particular, there is a need for a microwave cooking enclosure for a pot pie which controls the exposure of microwave energy to the pot pie such that it cooks and browns in a manner associated with conventional ovens.

SUMMARY OF THE INVENTION

The present invention is directed to an enclosure for cooking a pot pie, or a similar food item, in a microwave oven by modifying the heating characteristics of the microwave energy in order to selectively cook and brown the pot pie to a desired degree. More specifically, the enclosure includes a first microwave reflective shield having a single hole therein for selectively reflecting or transmitting microwave energy. A susceptor layer, a material which is microwave interactive and which converts microwave energy to thermal energy, is positioned below the first reflective shield. A pan lined with a susceptor is positioned below the susceptor layer. A second microwave reflective shield also having a single hole therein for selectively transmitting and reflecting microwave energy can advantageously be positioned below the pan.

The arrangement and configuration of the reflective shields and the susceptor layer provide for the selective cooking and browning of a pot pie to a desired level which is both aesthetically and palatably pleasing. The present invention also provides consistent and more uniform cooking and browning of pot pies using various types of microwave ovens. This uniform cooking and browning of pot pies has not been satisfactorily achieved heretofore by using either conventional cartons or by cooking the pot pie without the use of a carton or package other than a conventional pan.

In another aspect, the enclosure of the present invention has a microwave susceptor layer positioned above the pan and a microwave reflective shield defining a single hole therein positioned below the pan. This configuration of the present invention also provides for the selective and consistent cooking and browning of pot pies or similar food items.

In yet further aspects of the present invention, the holes of the reflective shields correspond to the approximate size and shape of the pan, and are preferably aligned with each other, and the holes (or hole if only one reflective shield is used) are preferably aligned with the pan to achieve optimum cooking and browning of the food item or pot pie.

Other features and advantages of the invention will become apparent from the following detailed description taken in conjunction with the accompanying drawings, which illustrate, by the way of example, the principles of the invention.

BRIEF DESCRIPTION OF THE DRAWINGS

The accompanying drawings illustrate the invention. Specifically.

DESCRIPTION OF THE PREFERRED EMBODIMENTS

Figure 1:
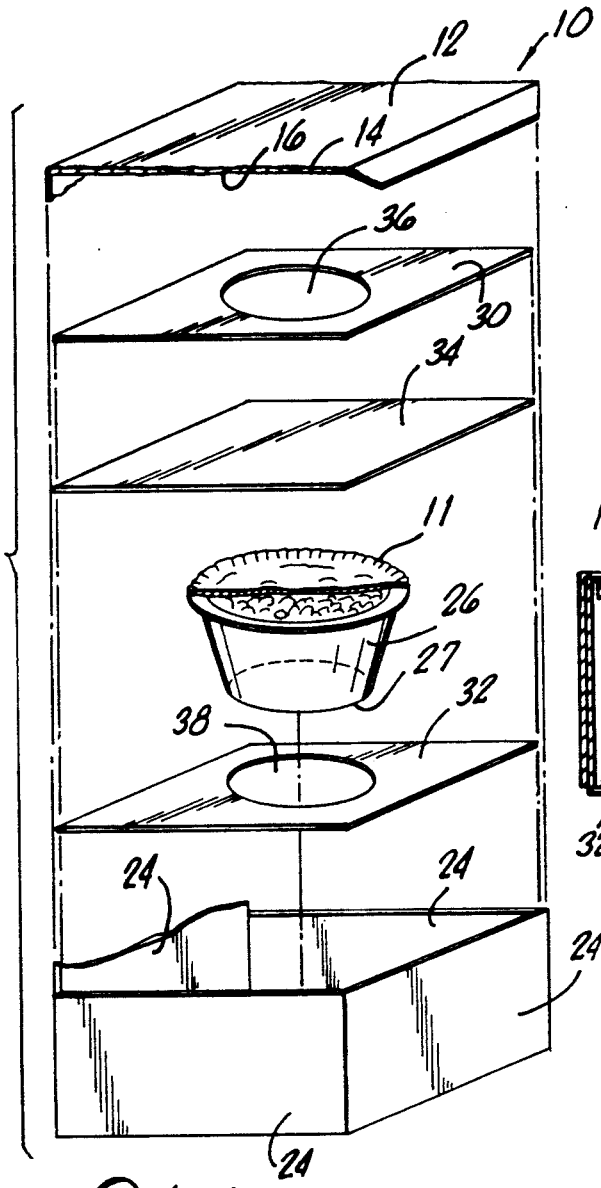
FIG. 1 is an exploded, perspective view of the enclosure of the present invention showing the reflective shields, the susceptor, the pan and the cross-section of a pot pie in the pan.
Figure 2:
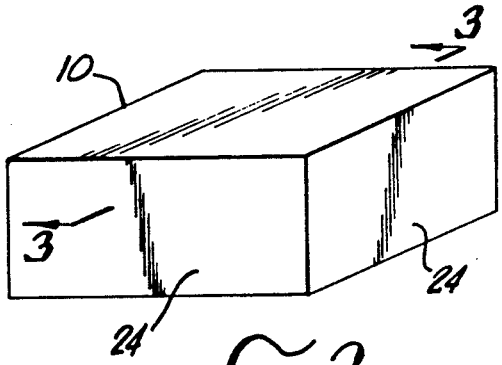
FIG. 2 is a drawing of the enclosure showing the plane of the perspective view of FIG. 1.

An enclosure in the form of a disposable carton 10 for cooking and browning a pot pie 11 or similar food item, such as a calzone, in a microwave oven is shown in FIGS. 1, 3–5 of the accompanying drawings. With particular reference to FIG. 1 of the drawings, the carton 10 has a top panel 12 having an upper surface 14 and a lower surface 16, and a bottom panel 18 having an upper surface 20 and a lower surface 22. The carton 10 also has a support structure for maintaining the top panel in an elevated position relative to the bottom panel 18, such as four side walls 24 as shown in the drawings. Paper or paperboard material commonly used for food packaging (such as those made from unitary blanks) is generally suitable for use with the present invention. For example, the present invention may make use of a carton with approximate dimensions of 5"×1½"×5", of 14 point (or 14/1000 of an inch thick) solid bleached sulfate paper (SBS). The carton 10 not only provides a highly advantageous cooking structure but serves as part of the packaging that would otherwise be required to store, ship and handle the food item. However, this size carton is described by way of example only, and it should be understood that many other suitably sized and shaped structures can be used for supporting the arrangement of susceptors and reflective shields as set forth below.

As shown in FIGS. 1, 3, 4 and 5, a pan 26 for containing a pot pie 11 (FIG. 1) is situated between the top 12 and bottom 18 panels of the carton 10. The inner layer or lining 28 of the pan 26 immediately adjacent the pot pie 11 includes a susceptor material. As shown in the drawings, a typical frustroconically shaped pot pie pan 26 with a circular bottom 27 and transverse cross-section has been found to be suitable for use with the present invention. The susceptor-lined pan made by Pressware Inc. of Columbus, Ohio is particularly suitable for use with the present invention.

Susceptors, as they are generally referred to, are well known in the art and are devices which convert microwave energy to thermal energy. Typically, susceptors include a thin layer of microwave interactive material, such as aluminum, deposited on a substrate, such as polyester film, by vapor vacuum deposition or other means. Portions of the substrate may be demetallized in a particular pattern to provide stability to the susceptor and a specific heating response. The substrate with the microwave interactive material is usually further attached to a paper or paperboard backing. Examples of these types of susceptors are generally described in U.S. Pat. No. 4,641,005 to Seiferth and U.S. Pat. No. 4,267,420 to Brastad. However, other types of susceptors that have been proposed may be suitable for use with the present invention, including printed ink susceptors such as those described in U.S. Pat. No. 5,132,144.

Figure 3:
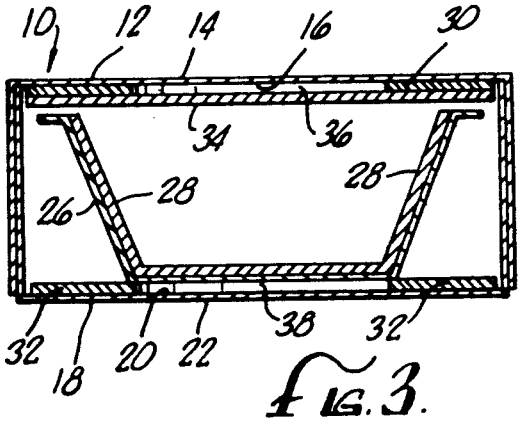
FIG. 3 is a cross-sectional view of the enclosure of FIG. 1, showing the reflective shields, the susceptor, and the pan.

With reference to FIGS. 1 and 3, the present invention is particularly directed to a carton 10 having first and second reflective shields (30 and 32, respectively) and a susceptor layer 34 specially arranged inside the carton such that the carton forms an enclosure that selectively cooks and browns the pot pie 11 in the pan 26 to the degree most pleasing to consumers and consistent with pot pies cooked in conventional ovens. More specifically, a first microwave reflective shield 30 is positioned below the lower surface 16 of the top panel 12. The first reflective shield 30 is preferably made of aluminum foil. However, it should be appreciated that other microwave reflective material may be used in place of foil. The first reflective shield 30 has a single hole 36 therein, selectively allowing microwave energy to pass therethrough. It has been found that a single hole corresponding to the approximate size and shape of the pan is particularly advantageous for optimum cooking and browning of a pot pie or food item. Preferably, for a circular, standard size pot pie (7 oz.) and pan, the first reflective shield 30 has a square configuration of 4¾"4¾", and has a circular hole 36 with a diameter of about three inches.

As mentioned above and as shown in FIGS. 1 and 3, a susceptor layer 34 is positioned below the first reflective shield 30. The susceptor layer 34 is as large in area as that of the hole 36 of the first reflective shield 30 such that it is sufficient to cover the hole. The susceptor 34 is capable of absorbing the microwave energy passing through the hole 36 of the first reflective shield 30 and converting it to heat for cooking and browning the pot pie 11. Although the susceptor 34 as shown in the figures is positioned immediately adjacent the first reflective shield 30, it should be understood that it can be spaced from but preferably aligned with the shield, and that additional layers of microwave transmissive material can be placed between the shield and susceptor, or between the top panel and the shield. Thus, the terms "below" or "above" or "adjacent" are used herein to give the relative position or location of a shield or layer in relation to another panel, shield or layer, and are inclusive as to whether they are contacting one another, spaced from one another, or have additional layers in between one another.

As shown in FIGS. 1 and 3 of the drawings, the carton 10 of this embodiment of the present invention is provided with a second reflective shield 32 also having a single hole 38 therein for selectively allowing microwave energy to pass therethrough. The second reflective shield 32 is also preferably made of aluminum foil. However, as with the first reflective shield 30, the second reflective shield 32 can be made from other material which is capable of reflecting microwave energy. The second reflective shield 32 is placed adjacent to the upper surface 20 of the bottom panel 18. The hole 38 of the second reflective shield 32 allows for the selective transmission of microwave energy at the bottom of the carton 10 to further aid the selective cooking and browning of the pot pie 11.

As with the first shield 30, the second reflective shield 32 preferably corresponds to the approximate size and shape of the pan 26 and hence the pot pie 11. It has been found that this configuration of the holes 36 and 38 in the first and second shields 30 and 32 in further conjunction with the susceptor layer 34 results in the optimum cooking and browning of the food item or pot pie 11. Preferably, for a standard size pot pie (as described above), the exemplary second reflective shield 32 has a square configuration of 4¾"×4¾", and has a circular hole 38 of 2½ inches in diameter.

It has also been found that the holes 36 and 38 of the first and second shields 30 and 32 should be vertically aligned with one another such that they share a common, imaginary central axis. For optimum cooking and browning, the holes 30 and 32 are preferably further aligned with the pan 26 (and, hence, the food item in the pan). In this regard, for a typical pot pie and pan having a circular bottom, the holes 36 and 38 of the reflective shields 30 and 32 should be circular and concentrically aligned with each other, and preferably with the circular bottom 27 of the pan 26, such that they share a common imaginary axis through their centers.

The arrangement of the first and second reflective shields 30, 32 and the susceptor layer 34 with respect to the pan 26 provide for the desired selective cooking and browning of the pot pie 11 that has heretofore not been satisfactorily achieved by conventional microwave pot pie pans or microwave packages. Thus, it is believed that this particular arrangement allows the microwave energy to impinge upon selected portions of the susceptors (including the susceptor in the pan) and the pot pie 11 to sufficiently cook and brown the pot pie to the degree that consumers would expect using a conventional oven. It is also believed that the arrangement of the first and second reflective shields 30 and 32 concentrates or forces the microwave energy to particular areas of the susceptor layer 34 and pot pie pan 26 to provide heat and/or microwave energy where needed to enhance the cooking and browning of the pot pie 11.

By way of example, the carton 10 of the above-described embodiment of the present invention is suitable for cooking and browning to the desired degree a chicken pot pie weighing 7 oz. in a 650 watt microwave oven on high for 6 to 9 minutes. A pot pie cooked under these conditions will be fully cooked and browned to the degree generally desired by consumers.

Figure 5:
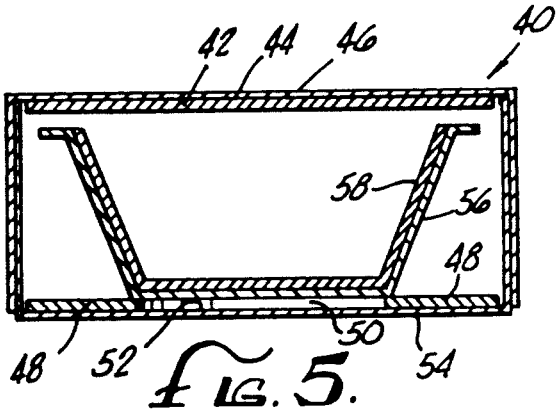
FIG. 5 is a cross-sectional view of the enclosure of FIG. 4 showing the susceptor, the reflective shield and the pan.
Figure 4:
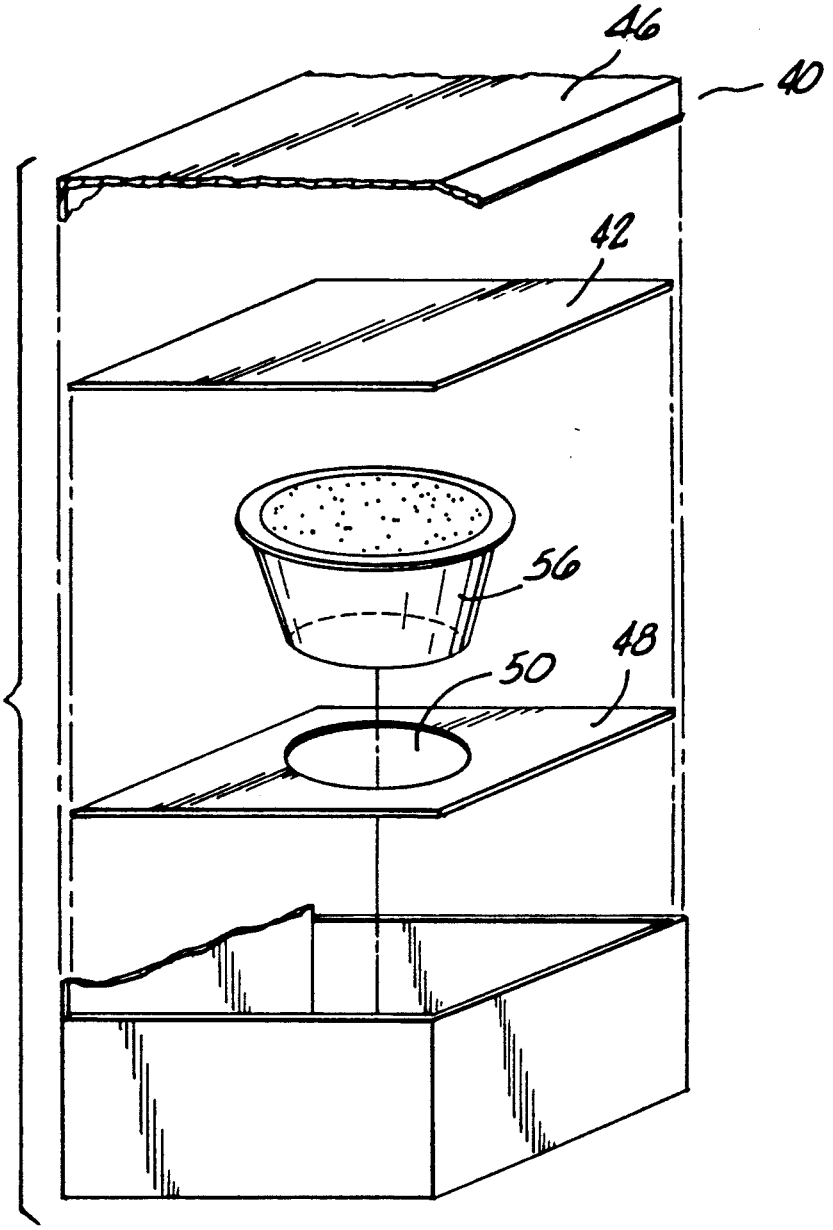
FIG. 4 is an exploded perspective view of the enclosure of the present invention showing the susceptor, the pan and the reflective shield on the bottom panel of the enclosure.

In another embodiment of the present invention, as shown in FIGS. 4 and 5, a carton 40 has a susceptor layer 42 positioned adjacent the lower surface 44 of the top panel 46, and a reflective shield 48 defining a single hole 50 therein is positioned adjacent the upper surface 52 of the bottom panel 54. In other words, the susceptor and the reflective shield are located on opposite sides of the pan 56. Preferably, for this embodiment, the exemplary reflective shield 48 has a square configuration of $4\frac{3}{4}'' \times 4\frac{3}{4}''$, and has a circular hole 50 of $2\frac{1}{4}$ inches in diameter. The pan 56 has a susceptor lining 58, as in the embodiment described above, for converting microwave energy to heat. The present invention also contemplates having a reflective shield 36 defining a single hole therein and a susceptor layer 34 positioned below the reflective shield but above the pan 26 (as shown in FIG. 1 except without the reflective shield 32 adjacent to the bottom panel 18 or on the opposite side of the pan.) Also with these embodiments and as disclosed above, it has been found that a hole corresponding in approximate size and shape to the pan is preferable for achieving the optimum cooking and browning of the pot pie. Also, the hole in the reflective shield of either one of these embodiments is preferably aligned with the pan to further achieve optimum cooking of the pot pie.

While particular forms of the invention have been illustrated and described, it will be apparent that various modifications can be made without departing from the spirit and scope of the invention. Accordingly, it is not intended that the invention be limited, except as defined by the appended claims.

We claim:

1. An enclosure for cooking and browning a food item in a microwave oven, comprising:

a pan for containing the food item and having a susceptor lining for converting microwave energy to thermal energy for cooking the food item;

a first microwave reflective shield defining a single hole therein;

a susceptor layer positioned below the first reflective shield and above said pan; and a second microwave reflective shield defining a single hole therein and positioned below said pan, whereby the enclosure provides for the selective cooking and browning of a food item when cooked in the enclosure.

2. The enclosure of claim 1, wherein the pan contains a food item.

3. The enclosure of claim 1, wherein the area of the susceptor layer is at least as large as that of the hole of the first reflective shield.

4. The enclosure of claim 1, wherein the hole of the first reflective shield and the hole of the second reflective shield correspond to the approximate size and shape of the pan.

5. The enclosure of claim 4, wherein said holes are aligned with each other.

6. The enclosure of claim 5, wherein the holes are further aligned with the pan.

7. The enclosure of claim 4, wherein the hole of the first reflective shield and the hole of the second reflective shield are circular.

8. The enclosure of claim 7, wherein the hole in the first reflective shield is about 3 inches in diameter and the hole in the second reflective shield is about $2\frac{1}{2}$ inches in diameter.

9. The enclosure of claim 7, wherein said holes are concentrically aligned.

10. The enclosure of claim 9, wherein the pan has a circular bottom which is concentrically aligned with the holes of said first and second reflective shields for optimum cooking and browning of the food item.

11. The enclosure of claim 10, wherein the pan contains a food item.

12. A carton for cooking and browning a pot pie in a microwave oven, comprising:

a carton having a top panel, a bottom panel and a supporting structure for maintaining said top panel in an elevated position relative to said bottom panel;

a pan for containing a pot pie, the pan positioned in the carton between the top and bottom panels and having a susceptor lining for converting microwave energy to thermal energy for cooking the pot pie;

a first microwave reflective shield defining a single hole therein;

a susceptor layer positioned below the first reflective shield and above said pan, such that the shield is located between the top panel of the carton and the susceptor layer; and a second microwave reflective shield defining a single hole therein and positioned below said pan, whereby the carton provides for the selective cooking and browning of a pot pie when cooked in the carton.

13. The carton of claim 12, wherein the pan contains a pot pie.

14. The carton of claim 12, wherein the area of the susceptor layer is at least as large as that of the hole in said first microwave reflective shield.

15. The carton of claim 12, wherein the supporting structure for maintaining said top panel in an elevated position relative to said bottom panel is comprised of four side walls.

16. The carton of claim 12, wherein the hole of the first reflective shield and the hole of the second reflective shield correspond to the approximate size and shape of the pan.

17. The carton of claim 16, wherein said holes are aligned with each other.

18. The carton of claim 17, wherein the holes are further aligned with the pan.

19. The carton of claim 16, wherein the hole of the first reflective shield and the hole of the second reflective shield are circular.

20. The carton of claim 19, wherein the hole in the first reflective shields is about 3 inches in diameter and the hole in the second reflective shield is about 2½ inches in diameter.

21. The carton of claim 19, wherein said holes are concentrically aligned with each other.

22. The carton of claim 21, wherein said pan has a circular bottom which is concentrically aligned with the holes of said first and second reflective shields for optimum cooking and browning of the pot pie.

23. The carton of claim 22, wherein the pan contains a pot pie.

24. A carton for cooking and browning a pot pie in a microwave oven, comprising:

a carton having a top panel, a bottom panel and four side walls;

a pan containing a pot pie, said pan having a susceptor lining for converting microwave energy to thermal energy for cooking the pot pie, said pan positioned in the carton between the top and bottom panels;

a first microwave reflective shield defining a single hole therein positioned adjacent to the top panel;

a susceptor layer positioned below the first reflective shield and above said pan such that the shield is located between the top panel of the carton and the susceptor layer; and a second microwave reflective shield defining a single hole therein positioned adjacent to the bottom panel of the carton, said hole of the first shield and said hole of the second shield correspond to the approximate size and shape of the pot pie to be cooked in the carton, said holes are aligned with one another and are further aligned with the pan, whereby the carton provides for the selective cooking and browning of a pot pie when cooked in the carton.

25. An enclosure for cooking and browning a food item in a microwave oven, comprising:

a pan for containing a food item, said pan having a susceptor lining for cooking and browning the food item;

a susceptor layer positioned above said pan; and a microwave reflective shield defining a single hole therein, said reflective shield positioned below the pan, whereby the enclosure provides for the selective cooking and browning of a food item when cooked in the enclosure.

26. The enclosure of claim 25, wherein the pan contains a food item.

27. The enclosure of claim 25, wherein the pan is positioned between a top panel and a bottom panel of the enclosure and further comprising a support structure for maintaining said top panel in an elevated position relative to said bottom panel.

28. The enclosure of claim 25, wherein the hole of the reflective shield corresponds to the approximate size and shape of the pan.

29. The enclosure of claim 28, wherein said hole is aligned with the pan.

30. The enclosure of claim 28, wherein the hole of the reflective shield is circular and has a diameter of about 2¼ inches.

31. The enclosure of claim 28, wherein the hole is circular and wherein the pan has a circular bottom which is concentrically aligned with the hole.

32. The enclosure of claim 31, wherein the pan contains a food item.

33. An enclosure for cooking and browning a food item in a microwave oven, comprising:

a top panel, a bottom panel and a support structure for maintaining said top panel in an elevated position relative to said bottom panel;

a pan for holding a food item, said pan having a susceptor lining for cooking and browning said food item;

a susceptor layer positioned above said pan; and a reflective shield defining a single hole therein, said reflective shield positioned below the top panel, such that it is located between the top panel and the susceptor layer, whereby the enclosure provides for the selective cooking and browning of a food item when cooked in the enclosure.

34. The enclosure of claim 33, wherein the pan contains a food item.

35. The enclosure of claim 33, wherein the hole of the reflective shield corresponds to the approximate size and shape of the pan.

36. The enclosure of claim 35, wherein the hole is aligned with the pan.

37. The enclosure of claim 36, wherein the hole is circular and wherein the pan has a circular bottom which is concentrically aligned with the hole.

38. The enclosure of claim 37, wherein the pan contains a food item.

39. The enclosure of claim 35, further comprising:

a second microwave reflective shield defining a single hole therein, said second shield positioned above the bottom panel of said carton such that it is located between the pan and the bottom panel.

40. The enclosure of claim 39, wherein the holes of said first and second shield are aligned with each other.

41. The enclosure of claim 40, wherein the holes are aligned with the pan.

42. The enclosure of claim 41, wherein the pan contains a food item.

* * * * *